United States Patent [19]

Lugli

[11] Patent Number: 4,841,994

[45] Date of Patent: Jun. 27, 1989

[54] MOUTH-PIECE FOR FILTERING THE SMOKE OF CIGARETTES AND THE LIKE

[76] Inventor: Carlo Lugli, Avenida Los Jabillos - Edificio Aconcagua - La Florida, Caracas, Venezuela

[21] Appl. No.: 19,044

[22] Filed: Feb. 26, 1987

[30] Foreign Application Priority Data

Mar. 6, 1986 [IT] Italy ..... 40019 A/86
Mar. 6, 1986 [IT] Italy ..... 40020 A/86

[51] Int. Cl.[4] ..... A24D 3/04

[52] U.S. Cl. ..... 131/210; 131/211; 131/212.1; 131/212.2; 131/216

[58] Field of Search ..... 131/339, 340, 336, 198.1, 131/198.2, 210, 211, 212.2, 216

[56] References Cited

U.S. PATENT DOCUMENTS 4,344,444 8/1982 Miura ..... 131/210
4,370,988 2/1983 Terasaki ..... 131/210

*Primary Examiner*—V. Millin
*Attorney, Agent, or Firm*—Miller & Gibbons

[57] ABSTRACT

The mouth-piece comprises a tubular body which accommodates a filter element which defines, with the inner walls of the tubular body, a first collection chamber for the combustion products, while a second collection chamber for the condensation products is defined in the same tubular body by a slot which extends into the tubular body and is rigidly connected thereto. The filter element has a nucleus of truncated cone shape, which is completely inserted inside the tubular body and has a face in abutment with the end of a cigarette.

7 Claims, 2 Drawing Sheets

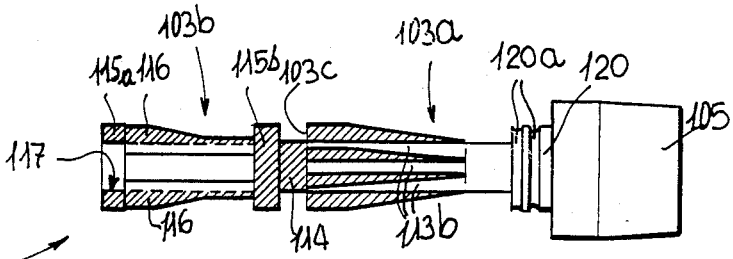
FIG.4
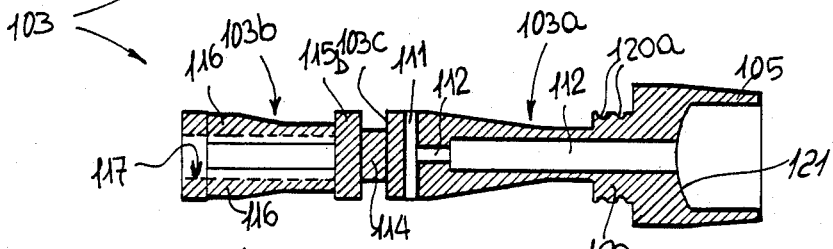
FIG.6
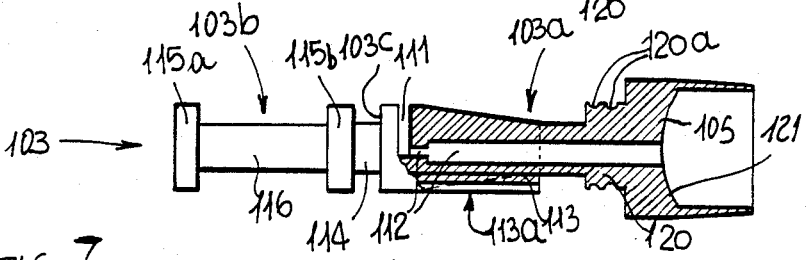
FIG.5
FIG. 7
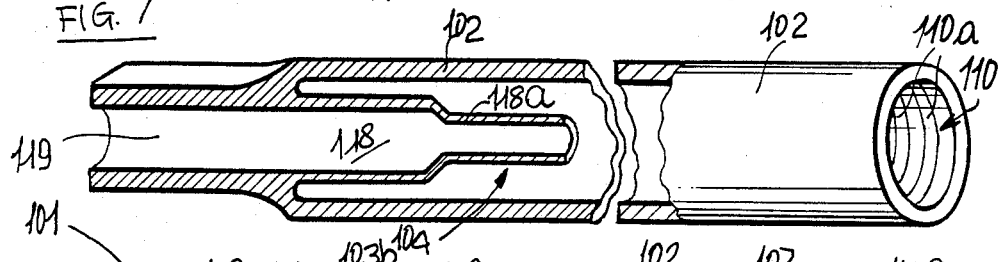
FIG.8
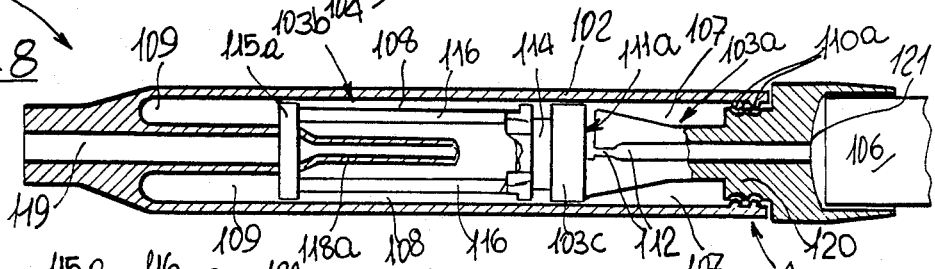
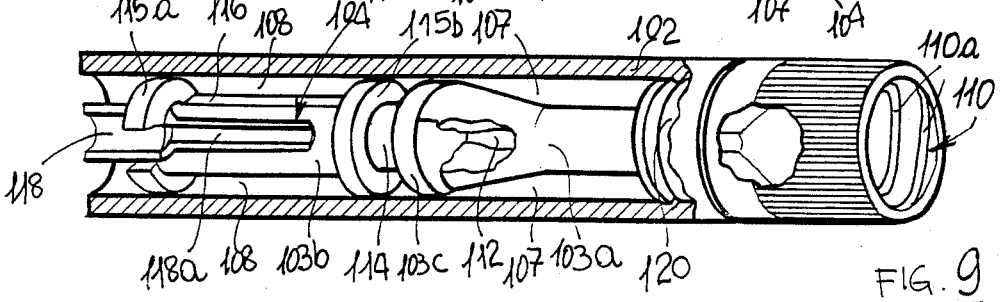
FIG. 9

MOUTH-PIECE FOR FILTERING THE SMOKE OF CIGARETTES AND THE LIKE

BACKGROUND OF THE INVENTION

The present invention relates to an improved mouthpiece for filtering the smoke of cigarettes and the like.

The number and the nature of the damages which the habit of smoking causes to the body are well known.

Countless attempts have been made to devise filters which can significantly reduce the amount of nicotine, tobacco and other products of combustion which are inhaled by smokers and become deposited throughout the respiratory tract.

The prior art has produced paper filters which have been included at one end of the cigarettes, yielding, however, a very small filtering capacity.

Other types of filters, the so-called mouthpieces, have partly improved the filtering capacity, but, in contrast, have some disadvantages, among which one can mention the inability to reduce the temperature of the inhaled fumes, which is the primary cause of damage to the larynx, the need for frequent replacements due to the significant reduction of the filtering ability according to the number of cigarettes smoked, the accidental outlet of drops of condensate which bear combustion products in suspension, with the consequent production of bad tastes in the smoker's mouth or of stains on the clothing if the mouthpieces are stored in the pocket and, finally, the dimensions of the mouthpieces themselves, which do not currently allow for the acquisition of a large number thereof since the same would give rise to a considerable mass to be stored.

SUMMARY OF THE INVENTION

The aim proposed by the present invention is to eliminate the above described disadvantages by providing an improved mouth-piece with very small dimensions which has a good filtering capacity even if it is used for many cigarettes, does not give rise to the loss of condensate, significantly reduces the temperature of the inhaled smoke, and which, at the same time, has very small dimensions, so that it is convenient and easy to use and store.

This aim, and other objects which will become apparent hereinafter, are achieved by an improved mouthpiece for filtering the smoke of cigarettes and the like, comprising a tubular body which accommodates a filter element, means being provided to secure said filter element, characterized in that the outer walls of said filter element and the inner walls of said tubular body define a first collection chamber for the combustion and condensation products, and in that a second collection chamber for the condensation products is defined by the inner walls of said tubular body and of a slot which projects into said tubular body, said slot being axially traversed by a conduit which communicates with the outside of said tubular body.

BRIEF DESCRIPTION OF THE DRAWINGS

Further characteristics and advantages of the invention will become apparent from the detailed description of two preferred, but not exclusive, embodiments of an improved mouth-piece, illustrated only by way of non-limitative example in the accompanying drawings, wherein:

FIGS. 4, 5 and 6 are partial cross-section views of a monolithic filter element of second aspect of the mouthpiece according to the invention, each rotated with respect to each other by a right angle;

FIG. 7 is a schematic and partial cross section view of the ends of the tubular body of the mouthpiece in the second aspect of the invention;

FIG. 8 is a detail cross section view of the complete mouthpiece in the second aspect of the invention; and FIG. 9, finally, is a perspective view of some internal cross sections of the tubular body and of the filter assembly of the same mouthpiece of FIG. 8.

DESCRIPTION OF THE PREFERRED EMBODIMENTS

Figure 1:
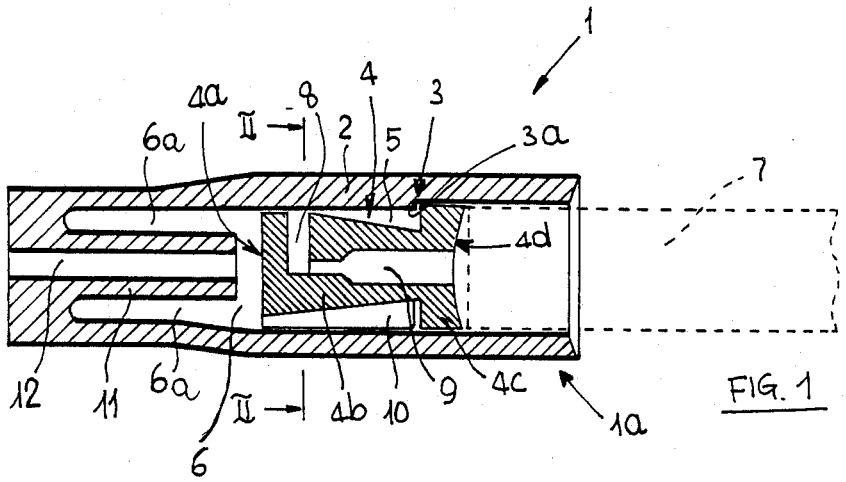
FIG. 1 is a longitudinal cross section view of a first embodiment of the mouthpiece according to the invention.
Figure 2:
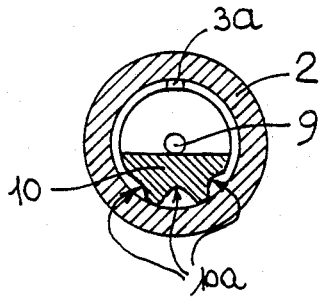
FIG. 2 is a cross section view along the plane II—II of FIG. 1.
Figure 3:
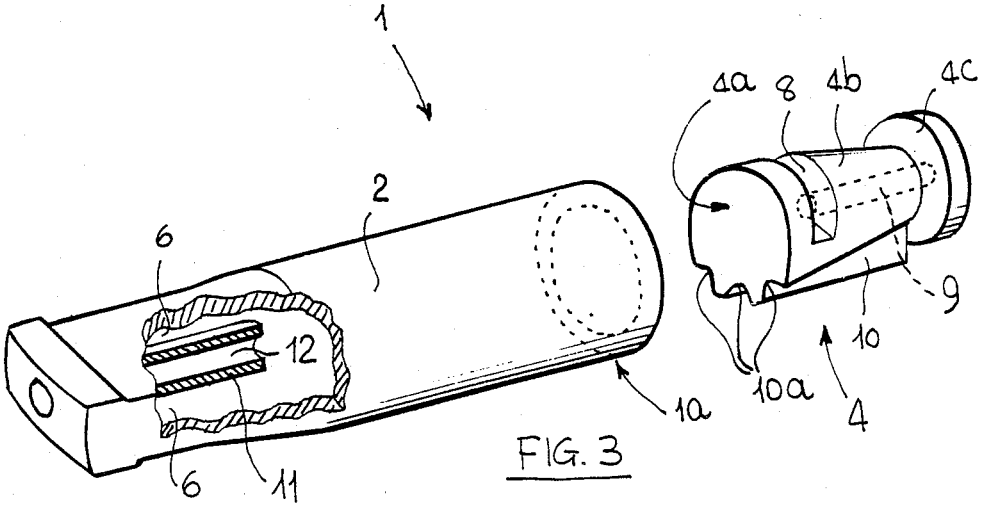
FIG. 3 is an exploded view of the same mouthpiece of FIG. 1 with partial views into the interior.

With particular reference to FIGS. 1–3, the reference numeral 1 indicates an improved mouthpiece with very small dimensions which comprises a short tubular body 2, in which is insertable, by pressing, until it abuts against related securing elements 3, a shaped filter element 4 which defines, between its own outer surface and the inner walls of the body 2, a first collection chamber 5 for the combustion products.

A second chamber 6 for collecting and containing condensation products is defined between a larger base **4*a* of the element 4 directed towards the smoker and matching inner cavities 6*a* of the tubular body 2**.

The securing elements 3 are composed of a sort of projecting step **3*a* which protrudes inwards from the wall of the tubular body 2** from a region placed substantially in the middle thereof.

The filter element 4 is composed of a nucleus **4*b* with the shape of a truncated cone, which is positioned coaxially to the tubular body 2; the smaller base is directed towards the inlet of the smoke produced by a cigarette 7 and is connected to a sort of small disk 4*c* the diameter of which coincides with the inner one of the tubular body 2 and has the face 4*d*, directed towards said cigarette 7**, affected by a slight concavity.

The nucleus **4*b* is affected by a transverse slit 8, parallel to the larger base 4*a* and arranged proximate thereto; it communicates with an axial aspiration conduit 9 which traverses the nucleus 4*b*, which conduit has two different diameters, the smaller of which is proximate to said slit 8**.

A tab 10 extends from the outer surface of the nucleus **4*b* until it touches the inner walls of the tubular body 2, which tab is longitudinally traversed by a plurality of grooves 10*a* parallel to each other and to the longitudinal axis of the element 4, for the passage of the inhaled smoke directed towards the second chamber 6**.

The latter is partially traversed by the tubular wall means including a cylindrical wall 11 which extends from the interior of the tubular body 2 longitudinally and centered, directed towards the larger base **4*a*, and is axially traversed by a conduit 12 which communicates with the outside of the tubular body 2**.

The operation of the invention is as follows: once the cigarette has been inserted in the initial portion **1*a* of the mouthpiece 1, it is pushed until it abuts with the face 4*d* of the small disk 4*c*; the concavity which affects it prevents the complete contact between the cigarette itself and the face 4***d*, thus allowing an easier flow of the inhaled smoke, which thus penetrates into the axial conduit 9 directed towards the slit 8; in this motion it is subject to an acceleration, due to the reduction of the diameter of said conduit 9, and then collides with the walls of the slit 8, thus losing kinetic energy and temporarily reversing its direction; simultaneously, the particles of combustion products present therein deposit in the first chamber 5.

As the inhaling action of the smoker continues, the smoke once more moves towards the outlet, passing between the grooves 10*a* of the tab 10.

It thus enters the second chamber 6, depositing therein the condensated substances, which, by cooling, change density, so that they can no longer accidentally leave the mouthpiece 1 through the conduit 12 of the cylindrical wall 11, as instead does the smoke, by then purified of a very large part of its harmful substances. It should be noted that the intentionally convoluted path which the smoke has to follow causes the same to have, at the outlet, a temperature which is significantly lower than at the inlet, to the full advantage of the protection of the larynx.

Furthermore, the extremely small dimensions of the entire invention make its use simple and make its storage and accumulation comfortable, as well as the possible use with a packet of cigarettes.

FIGS. 4–9 illustrate a second embodiment of the mouthpiece according to the invention, generally indicated with the reference numeral 101, which comprises a filter element 103 which is at least partially accommodated, in a tubular body 102 and is rigidly coupled with a second element 105, or capsule, to accommodate a cigarette 106.

In said filter element 103 it is substantially possible to identify a first element 103a and a second element 103*b*, which define between their shaped outer surfaces and the inner walls of the tubular body 102 a first chamber 107 and a third chamber 108 adapted to contain and deposit the filtered substances.

A second collection chamber 109 is provided between the end of the filter assembly 103, directed towards the outlet of the smoke, and the matching end of the tubular body 102 directed towards the smoker.

Between the end of the tubular body 102 directed towards the capsule 105 and the latter, means 110 are provided of the spring-latch type, for blocking the axial motion of the filter assembly 103 with respect to the body 102 itself.

Of said elements which constitute the filter body 103, the first element 103*a* has a substantially truncated cone shape, with the tapered end directed towards the inlet of the smoke and furthermore has its lateral surface affected by a transverse slit 111 arranged proximate to the larger base 103*c* and parallel thereto, which communicates with an axial conduit 112 for aspirating the smoke which has two diameters, the smaller of which is proximate to the same slit 111.

A projecting tab 113 extends from said lateral surface of the first element 103*a*, the outer surface 113*a* of which tab slideably contacts the inner walls of the tubular body 102 and is traversed by grooves 113*b* parallel to each other and to the longitudinal axis of the same element 103*a*.

The third element 103*b* is connected, at one end thereof, to the first element 103*a*, with the interposition of a small-diameter cylindrical spacer 114, and also has a cylinder-like shape, with each base composed of small disks 115*a*, 115*b* perpendicular to the axis of the body 102, which disks have a diameter which is slightly smaller than the inner diameter of the third chamber 108 and are connected to each other by two shaped straps 116 which face each other.

A through hole 117 is furthermore provided in the disk 115*a* which is directed towards the outlet of the smoke. The filter element 103 is associated to the tubular body 102 by support means 104 which comprise, at the smoke outlet end, tubular wall means forming a throat 118 which is axially hollow and communicates with the outside through a related conduit 119 which projects from the body 102, internally and coaxially thereto towards the interior of the second collection chamber 109, and the tip 118*a* of which can be tightly inserted into said through hole 117 until it interposes itself between the straps 116.

At the opposite end of the filter element 103, directed towards the inlet of the smoke, said support means 104 comprise a cylindrical collar 120, rigidly associated with said capsule 105, which has its lateral surface affected by parallel grooves 120*a*.

In these grooves said spring-latch means 110 engage, which means comprise a plurality of rings 110*a*, preferably in a number equal to the one of the grooves 120*a*, which extend protrudingly from the inner wall of the end of the tubular body 102 directed towards the capsule 105.

The opeation of the mouthpiece is as follows: once a lit cigarette has been inserted into the capsule 105, by inhaling the smoke thereof from the other end, this smoke penetrates into the axial conduit 112 and, once it is proximate to the slit 111, where its cross section has a narrowing, it acquires speed and then collides against the vertical wall 111*a* of the same slit and thus reverses its direction and penetrates into the first chamber 107, in which a large percentage of the combustion particles contained in the smoke is already deposited.

The latter, again under the effect of the inhaling, proceeds towards the outlet of the mouthpiece 101, passing through the grooves 113*b* as well as between the minimal interspaces which exist between the disc 115*b* and the inner walls of the body 102, to penetrate into the third chamber 108, in which it further loses the residual solid particles in suspension, as well as that part of the condensate which has formed therein, which condensate, by adhering to the walls of the body 102, transfers, and accumulates, inside the second chamber 109, thus being deprived of the possibility of leaking-out or of returning into the third chamber 108 since, in said transfer and accumulation, it changes density and cools, and the disk 115 forces it into said second chamber 109.

The smoke thus purified leaves through the axial conduit 119 of the stem or throat 118 and the related tip 118*a* to move towards the smoker.

When the first chamber 107, after a certain number of smoked cigarettes, is partly occupied by the residuals of the first deposit, by rotating the filter assembly 103 with respect to the body 102 the tab 113 scrapes the walls of said first chamber, cleaning them satisfactorily so as to offer, by accumulating in one point the residuals thus collected, new space available for further deposits of particles and consequently prolonging the operating cycle thus described for a further number of smoked cigarettes, and furthermore extending the lifespan of the mouthpiece 101.

It should be noted that, if required, it is also possible to extract the filter element 103 from the body 102 to clean it more accurately and completely.

In practice, it has been observed that the invention thus described achieves the intended aims, in that it significantly purifies the smoke inhaled from the cigarettes being smoked and, at the same time, does not give rise to accidental losses of condensation liquids, also offering a longer useful life.

The invention thus conceived is susceptible to numerous modifications and variations, all of which are within the scope of the inventive concept.

Moreover, all the details may be replaced with other technically equivalent elements.

In practice, the materials employed, as well as the dimensions, may be any according to the requirements, without thereby departing from the scope of the protection of the following claims.

I claim:

1. A mouthpiece for filtering smoke of cigarettes, comprising:

a tubular body having an inner wall, a smoke inlet end, a smoke aspiration end and an inner diameter;

tubular wall means extending in said tubular body at said smoke aspiration end;

an axial smoke outlet conduit formed in said tubular wall means;

a filter element accomodated in said tubular body and including a tubular filter body, said filter body having a first end base facing said smoke inlet end, a second end base facing said smoke aspiration end and a lateral surface extending between said first and second end bases and facing said inner wall of said tubular body, said first and second end bases having diameters substantially equal to said inner diameter of said tubular body;

an aspiration through cavity extending through said filter body from said end first base and ending at said lateral surface near to said second end base, said aspiration through cavity defining at said lateral surface an outlet opening;

at least one recessed portion formed on said lateral surface of said filter body near to said outlet opening, said recessed portion of said lateral surace defining with said inner wall of said tubular body a first collecting chamber;

a second collecting chamber formed between said second end base, said inner wall of said tubular body and said tubular wall means and including collecting cavities extending between said tubular body and said tubular wall means, wherein said second collecting chamber is separated from said first collecting chamber by said second end base of said filter body; and at least one through hole in said second end base of said filter body connecting said first chamber with said second chamber.

2. A mouthpiece for filtering smoke of cigarettes, comprising a tubular body having an inner wall, a smoke inlet end, a smoke aspiration end and an internal diameter; a filter element accomodated in said tubular body and having an outer wall; tubular wall means extending in said tubular body at said smoke aspiration end, an axial smoke outlet conduit formed in said tubular wall means; a first collecting chamber formed between said tubular body and said outer wall of said filter element, a second collecting chamber formed between said tubular body and said tubular wall means, wherein said filter element comprises a truncated cone shaped nucleus defining an outer side surface, a first and a second mutually opposite bases, with said first base having smaller dimensions than said second base, said nucleus being arranged coaxially to said tubular body with said first base being directed towards said smoke inlet end and being connected to a circular disk having a diameter substantially equal to said internal diameter of said tubular body, said nucleus further having a transverse slit extending parallel and proximate to said second base, communicating with an axial smoke aspiration conduit, formed longitudinally in said nucleus, said mouthpiece further comprising a tab projecting outwards from said outer side surface of said nucleus, engaging in sliding contact engagement with said inner wall of said tubular body and being traversed by groove substantially parallel to each other and to the axis of the tab, for permitting passage of smoke towards said second chamber, said smoke outlet conduit being in communication with said second collecting chamber through an aperture to permit smoke to flow therethrough.

3. A mouthpiece, according to claim 2, wherein said axial smoke aspiration conduit comprises a first conduit portion and a second conduit portion, said first conduit portion having a smaller diameter than said second conduit portion and being relatively short and proximate to said transverse slit, said second conduit portion being longer than said first conduit portion.

4. A mouthpiece for filtering smoke of cigarettes, comprising a tubular body having an inner wall, a smoke inlet end, a smoke outlet end and an inner diameter; a filter element accommodated in said tubular body; tubular wall means extending within said tubular body at said smoke outlet end; a smoke outlet conduit axially extending in said tubular wall means; a first collecting chamber formed between said tubular body and said outer wall of said filter element; a second collecting chamber formed between said tubular body and said tubular wall means, wherein said filter element comprises a first element having a truncated cone shape defining a lateral outer surface, a first and a second mutually opposite bases, with said first base having smaller dimensions than said second base, said first base being directed towards said smoke inlet end and said lateral outer surface having a transverse slit, arranged proximate to said second base and communicating with an axial smoke aspiration conduit formed in said first element, said first element further comprising a protruding tab projecting from said lateral outer surface of said first element and having an outer surface which is in sliding contact with said inner wall of said tubular body and is traversed by aspiration grooves extending parallel to said tubular body, said first element defining with said tubular body said first collecting chamber; a second element including a cylindrical capsule adapted for at least partially accommodating a cigarette, said second element being connected to said first base of said first element; a third element connected to said second base of said first element through a spacer, said third element defining a first and a second opposite disk-like bases, said first and a second disk-like bases extending perpendicular to said tubular body, having a diameter which is slightly smaller than said inner diameter of said tubular body, and being connected to each other by at least two shaped and facing straps, with said first disk-like base being directed towards said smoke outlet end and having a through hole, said third element defining with said tubular body a third chamber for containing and depositing filtered substances, said third chamber being arranged between said first chamber and said second chamber.

5. A mouthpiece, according to claim 4, wherein said axial smoke aspiration conduit comprises a first conduit portion and a second conduit portion, said first conduit portion having a smaller diameter than said second conduit portion and being relatively short and proximate to said transverse slit, said second conduit portion being longer than said first conduit portion.

6. A mouthpiece, according to claim 4, further comprising securing means for securing said filter element in said tubular body, said securing means including said tubular wall means, said tubular wall means having a tip inserted in said through hole of said first disk-like base between said straps of said second element; said securing means further comprising a cylindrical collar, coaxially connected to said capsule and having parallel grooves for engagement with spring-latch means arranged on said inner wall of said tubular body.

7. A mouthpiece according to claim 6, including a plurality of said parallel grooves, said spring-latch means comprising an equal plurality of projecting rings.

* * * * *